United States Patent [19]

Niimi et al.

[11] 4,258,602

[45] Mar. 31, 1981

[54] ELECTRONIC KEYBOARD MUSICAL INSTRUMENT OF WAVE MEMORY READING TYPE

[75] Inventors: Koji Niimi; Mitsumi Kotah, both of Hamamatsu, Japan

[73] Assignee: Nippon Gakki Seizo Kabushiki Kaisha, Japan

[21] Appl. No.: 922,756

[22] Filed: Jul. 7, 1978

[30] Foreign Application Priority Data

Jul. 12, 1977 [JP] Japan ..... 52/82609

[51] Int. Cl.[3] ..... G10H 1/08; G10H 5/00; G10H 7/00

[52] U.S. Cl. ..... 84/1.01; 84/1.22

[58] Field of Search ..... 84/1.01, 1.03, 1.11–1.13, 84/1.19, 1.21, 1.22, 1.24–1.27, DIG. 2, DIG. 20

[56] References Cited

U.S. PATENT DOCUMENTS

| | | | |
|---|---|---|---|
| 3,515,792 | 6/1970 | Deutsch | 84/1.03 |
| 3,979,989 | 9/1976 | Tomisawa et al. | 84/1.01 |
| 4,077,294 | 3/1978 | Hiyoshi et al. | 84/1.24 X |
| 4,083,283 | 4/1978 | Hiyoshi et al. | 84/1.24 |
| 4,108,036 | 8/1978 | Slaymaker | 84/1.01 |
| 4,114,498 | 9/1978 | Chibana et al. | 84/1.19 |
| 4,130,043 | 12/1978 | Niimi | 84/1.03 |
| 4,133,242 | 1/1979 | Nagai et al. | 84/1.13 |
| 4,133,244 | 1/1979 | Hiyoshi et al. | 84/1.26 |
| 4,138,915 | 2/1979 | Nagai et al. | 84/1.22 |

FOREIGN PATENT DOCUMENTS

| | | |
|---|---|---|
| 1935306 | 1/1971 | Fed. Rep. of Germany . |
| 2709530 | 9/1977 | Fed. Rep. of Germany . |
| 2709560 | 9/1977 | Fed. Rep. of Germany . |

*Primary Examiner*—S. J. Witkowski

*Attorney, Agent, or Firm*—Ostrolenk, Faber, Gerb & Soffen

[57] ABSTRACT

In an electronic keyboard musical instrument, the operation of a key causes a corresponding frequency information signal to be read out of a frequency information memory. The frequency information signal represents a counting number and is repeatedly accumulated in an accumulator at a first clock rate. The accumulator generates carry signals at a frequency defining a tone frequency. A wave shape memory stores sample values of a wave shape, and a counter addresses this memory to read out the wave shape. The counter is driven at a second clock rate to successively address the sample values one after another, but is reset by the carry signals to restore it to its initial state. Thus the memory generates only those sample values of the wave shape which fall within the carry signal period from the beginning. The tone colors will vary from one tone frequency to another.

16 Claims, 12 Drawing Figures

ELECTRONIC KEYBOARD MUSICAL INSTRUMENT OF WAVE MEMORY READING TYPE

BACKGROUND OF THE INVENTION

The present invention relates to an electronic keyboard musical instrument of a wave memory reading type, and more particularly relates to an improvement in the musical tone generating system in which sample values constituting a musical tone are stored in different address location of wave shape memory and are read out successively and repetitively in accordance with address signals corresponding to the operated key.

In the case of the conventional electronic keyboard musical instrument employing the above-described musical tone generating system, a single predetermined wave shape is stored in the memory and a whole cycle of the same sample values are read out at a clock rate defining the tone frequency for the operated key.

Therefore, although the reading frequency varies from one key to another, the wave shapes are identical for all the keys, and therefore the tone colors are also the same. For this reason, it is very difficult for the conventional electronic keyboard musical instrument to generate musical tones having a variety o tone colors varying from key to key as is the case with the natural acoustic musical instruments.

SUMMARY OF INVENTION

It is an object of the present invention to provide an electronic keyboard musical instrument which generates beautiful musical tones having a variety of tone colors which are different for different frequency tones as is the case with natural acoustic musical instruments.

It is another object of the present invention to provide an electronic keyboard musical instrument assuring free modulation of tone colors of musical tones to be generated.

It is a further object of the present invention to provide an electronic keyboard musical instrument assuring unlimited free modulation of tone colors of musical tones to be generated without causing any enlargement in construction of the instrument.

In accordance with the present invention, the musical instrument comprises at least one wave shape memory storing sample values of a desired wave shape, a read-out circuit generating address signals for the memory at a constant speed, and a reset signal generator circuit for resetting the read-out circuit at a period variably corresponding to operated keys.

Known time division techniques may be employed in order to carry out complicated tone color modulation with compactness in construction.

DESCRIPTION OF THE PREFERRED EMBODIMENTS

Figure 1:
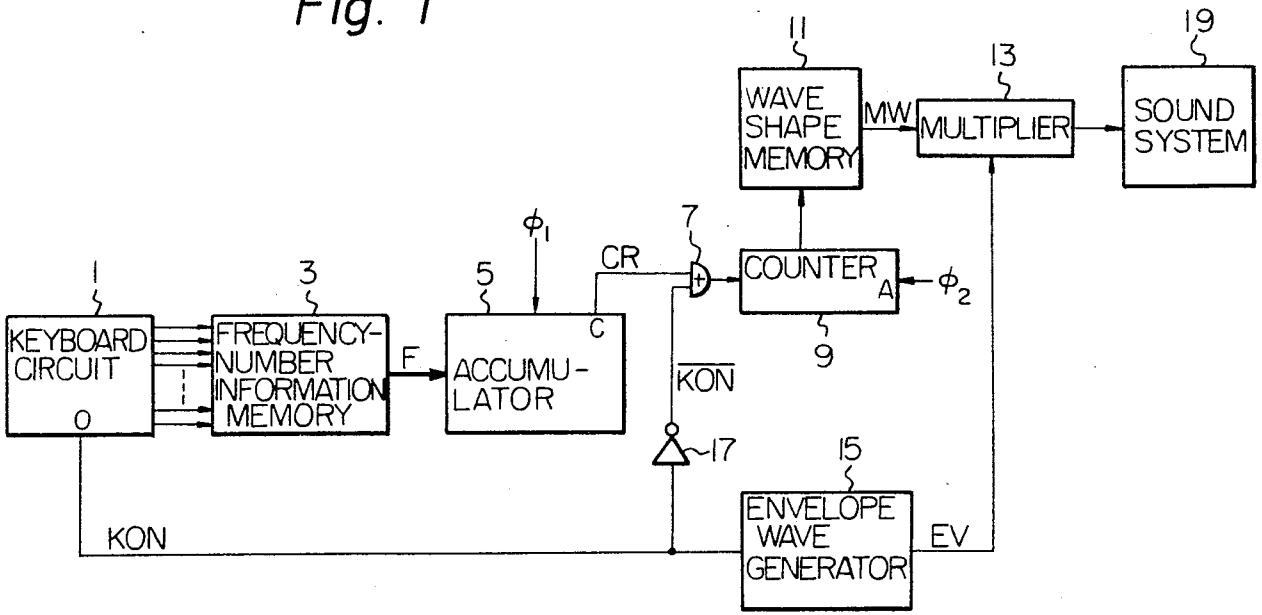
FIG. 1 is a block diagram illustrating the construction of a first embodiment of the present invention.

A first embodiment of the present invention is shown in FIG. 1. As shown therein, a keyboard circuit 1 has first and second sets of output terminals 40, 41. Each of the output terminals 40 are coupled to respective input terminals of a frequency information memory 3 and the output terminal of the frequency information memory 3 is coupled to the input terminal of an accumulator 5. The carry signal output terminal C of the accumulator 5 is coupled to the reset terminal R of a counter 9 via an OR gate 7. Clock pulses $\phi_1$ are applied to the clock terminal of accumulator 5 and clock pulse signals $\phi_2$ are applied to input terminal A of counter 9. The output terminals of the counter 9 are coupled to the address input terminals of wave shape memory 11 whose output terminal is coupled to the first input terminal of a multiplier 13.

The keyboard circuit 1 generates key-on signals KON (binary "1"'s) each of which indicates that its corresponding key has been operated. Each of the second terminals 41 only one of which is shown of the keyboard circuit 1 are coupled, in parallel to each other, directly to the trigger input terminal of an envelope wave generator 15 and, via inverter 17 and the OR gate 7, to the reset terminal R of the counter 9. The output terminal of the envelope wave generator 15 is coupled to the second input of the multiplier 13, the output of which is coupled to a sound system 19 which includes components such as an amplifier and a loud speaker.

When a key in the keyboard is operated, the keyboard circuit 1 generates a binary which is applied "1" to the output line 40 corresponding to the operated key. The keyboard circuit 1 includes a single tone selecting circuit (preference circuit) which enables selection of a single tone to be produced when two or more keys are operated simultaneously. Thus, this embodiment is a preferably monophonic musical instrument.

Each address of the frequency information memory 3 stores corresponding frequency information signals F, each of which take the form of constants and are proportional to the tone pitches (frequencies) of the key with which it is associated. Particularly, an address for a key of a high note stores a large numerical value whereas an address for a key of a low note stores a small numerical value.

Figure 2A:
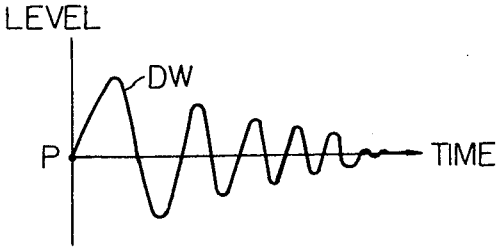
FIG. 2A is a graph illustrating an example of the wave stored in the wave shape memory used in the embodiment illustrated in FIG. 1.

The wave shape memory 11 stores a decaying oscillatory wave DW such as the one shown in FIG. 2A.

Figure 2B:
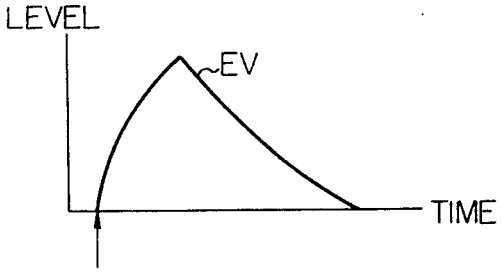
FIG. 2B is a graph illustrating one example of the envelope wave generated by the envelope wave generator used in the FIG. 1.

Upon receipt of a key-on signal KON (a binary "0" indicating that a certain key is operated, the envelope wave generator 15 generates an envelope wave EV such as the one shown in FIG. 2B which has the shape of a percussive envelope and is used to control the tone volume (amplitude).

With the above-described construction, the electronic keyboard musical instrument in accordance with the present invention operates as follows.

When a key is operated in the keyboard, a logic value "1" is generated at a corresponding output line 40 in the keyboard circuit 1. Upon receipt of this logic value "1" from the keyboard circuit 1, the frequency information memory 3 reads generates out a frequency information signal F which corresponds to the note frequency of the operated key. The frequency information signal F is applied to the accumulator 5 which accumulates the frequency information signals F sequentially at times defined by the clock pulse signals $\phi_1$.

Each time the accumulated number of the frequency information signal F exceeds the full count number of the accumulator 5, a carry signal CR is generated and applied to the carry signal output terminal C of the accumulator 5.

As already described, a series of different frequency information signals F, corresponding to different keys, are stored in regular order, i.e. from high to low, in different address locations of the frequency information memory 3. Therefore, the period T of each of the carry signals CR generated by the accumulator 5 is inversely proportional to the frequency information memory 3. In other words, the above-described period T is inversely proportional to the pitch of each key. Therefore when a key for a high note is operated, the period T of the carry signals is short whereas the period T is long when a key for a low note is operated.

As is clear from the foregoing description, upon operation on a particular key, the accumulator 5 outputs from its terminal C carry signals CR at a constant period T which corresponds to the note of the operated key. The carry signals CR so outputted is then passed, as reset signals, to the counter 9 via the OR gate 7.

Figure 3A:
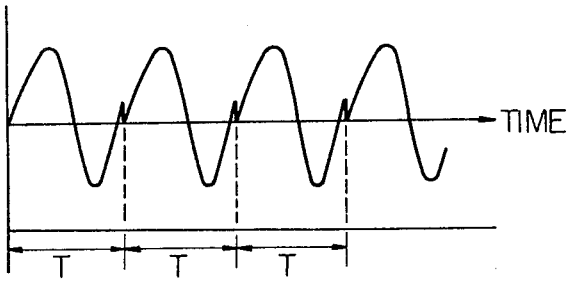
FIGS. 3A and 3B are graphs illustrating examples of the wave shape signal output from the wave shape memory used in the embodiment FIG. 1.
Figure 3B:
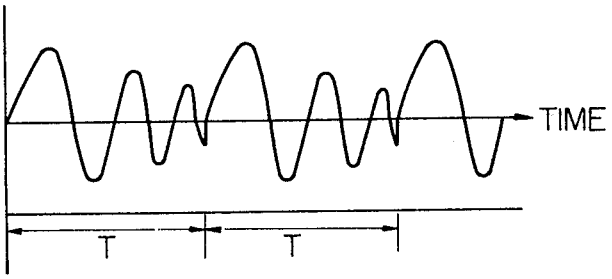

Concurrently with the above-described process, operation of a certain key permits the counter 9 to start counting the clock pulses $\phi_2$ from the count value "1" and the count values are sequentially applied, as address signals, to the wave shape memory 11. Upon receipt of the address signals, the wave shape memory 11 sequentially outputs the decaying oscillating waves DW shown in FIG. 2A in the form of wave shape signals MW. When the accumulated number in the accumulator 5 exceeds the allowable full count number under this situation, it outputs a carry signal CR from the terminal C as hereinbefore described. Upon receipt of this carry signal CR, the counter 9 is reset to zero and again begins counting the clock pulses $\phi_2$. As already described, the count values are applied to the wave shape memory 11 as address signals. So, the wave shape signal MW generated by the wave shape memory 11 at this stage of the process resumes the starting point P in the wave shape shown in FIG. 2A and the decaying oscillating wave DW shown in FIG. 2A is again read out. Thus, the wave shape signal MW generated by the wave shape memory 11 assumes a shape such as shown in FIG. 3A or 3B, which take the form of a repetition of constant unit wave shape. The period of the repetition is equal to the period T of the carry signals CR generated by the accumulator 5.

It will be clear from the foregoing that, when a key for a high note is operated and the generation period T of the carry signals CR is accordingly short, the wave shape memory 11 outputs the wave shape signal MW shown in FIG. 3A, in which the signal MW is formed by repetition of the large amplitude portion of the decaying oscillating wave DW shown in FIG. 2A only. In contrast, when a key for a low note is operated and the generation period T of the carry signals CR is long, the wave shape memory 11 outputs the wave shape signal MW shown in FIG. 3B, which includes also the small amplitude portion of the decaying oscillating wave DW shown in FIG. 2A.

The wave shape signal MW so formed is then multiplied at the multiplier 13 by the envelope wave EV given by the envelope wave generator 15 and the multiplied result is passed to the sound system 19 for generation of a corresponding musical tone.

Further, the key-on signals KON are applied to the reset terminal R of the counter 9 from the keyboard circuit 1 via the inverter 17 and the OR gate 7. When the key is not operated, an inversed key-on signal $\overline{KON}$ is applied to the counter 9 in order to reset the latter.

As is clear from the foregoing description, in the data processing system of the first embodiment of the present invention, the decaying oscillating waves DW stored in the wave shape memory 11 are sequentially read out at a constant speed defined by the clock pulse signals $\phi_2$ with the generation period T corresponding to the operated keys. As the wave shape signals MW for the musical tones are generated in such a fashion, different wave shapes, i.e. tone colors, can be generated for different keys.

Figure 4:
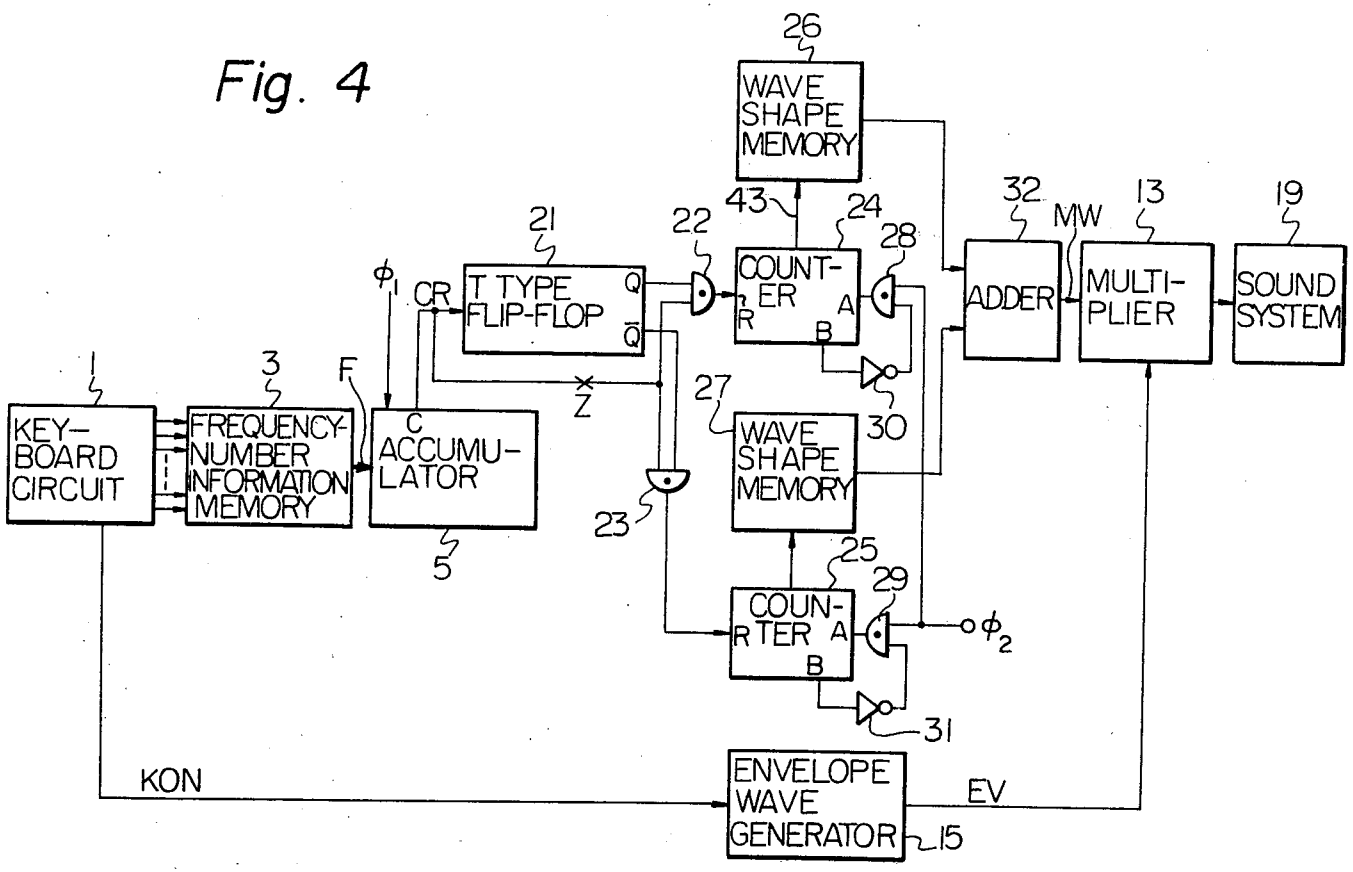
FIG. 4 is a block diagram illustrating the construction of a second embodiment of the present invention.

A second embodiment of the present invention is shown in FIG. 4, in which elements which are the same as those used in the first embodiment are designated with like reference symbols. In this embodiment, the carry signal output terminal C of the accumulator 5 is on coupled to both the input side of a T type flip-flop 21 and to the input side of an AND gate 22. One output terminal Q of the flip-flop 21 is coupled to the input side of AND gate 22. The output side of AND gate 22 is coupled to the reset terminal R of a counter 24. The remaining output terminal $\overline{Q}$ of the flip-flop 21 is coupled to the input side of an AND gate 23 whose output side is coupled to the reset terminal R of a counter 25.

The output side of the counter 24 is coupled to the address input side of a wave shape memory 26 whose output side is coupled to the first input terminal of an adder 32. Likewise, the output side of the counter 25 is coupled to the address input side of a wave shape memory 27 whose output side is coupled to the second input terminal of the adder 32. The output side of the adder 32 is coupled to the input side of a multiplier 13.

Clock pulse signals $\phi_2$ applied to the input sides of AND gates 28 and 29 whose output sides are coupled to the input terminal A of the counter 24 and to the input terminal A of the counter 25, respectively. The output terminal B of the counter 24 is coupled to the input side of AND gate 28 via an inverter 30. Likewise, the output terminal B of the counter 25 is coupled to the input side of AND gate 29 via an inverter 31. Here, the output terminals B of counters 24 and 25 function to generate binary "1" when the counter 24 and 25, respectively, has reached its maximum value and the contents of these counters are all binary "1"'s. The decaying oscillating waves DW, shown in FIG. 2A, are stored in the wave shape memories 26 and 27.

With the above-described construction, the electronic keyboard musical instrument in accordance with the present invention operates as follows.

When a certain key is operated in the keyboard, carry signals CR are generated by the accumulator 5 with a generation period T corresponding to the pitch of the operated key as in the first embodiment. Upon receipt of carry signals CR, with generation periods corresponding to pitches of the operated keys, the flip-flop 21 and the AND gates 22 and 23 operate as follows.

As the first carry signal CR is generated, flip-flop 21 receives the carry signal CR and generates a binary "1" on its Q output and a binary "0" on its $\overline{Q}$ output. As a result, AND gate 22 generates a binary "1" on its Q output and AND gate 23 generates a binary "0" on its $\overline{Q}$ output.

When the second carry signal CR is generated by the accumulator 5, flip-flop 21 inverts its state, generating a binary "0" on its Q output and a binary "1" on its $\overline{Q}$ output. As a result, AND gate 22 generates a binary "0" and AND gate 23 generates a binary "1".

The above-described operation is repeated each time a new carry signal CR is generated by accumulator 5. Therefore, AND gates 22 and 23 alternately generate binary "1" signals with a generation period 2T upon receipt of carry signals CR generated by the accumulator 5 with the generation period T. These signals are passed to the counters 24 and 25 as reset signals.

Operation of AND gate 28 and the inverter 30 in relation to the counter 24 and that of AND gate 29 and inverter 31 in relation to the counter 25 will hereinafter be explained in detail.

It is assumed that the count in counters 24 and 25 has already reached its maximum value. Under this condition, binary "1"'s are generated at terminals B of the counters 24 and 25, inverted at the inverters 30 and 31 to binary "0"'s, and applied to AND gates 28 and 29, respectively. As a result, both AND gates 28 and 29 are disabled when the counters 24 and 25 have already counted the respective allowable full count numbers. As a result, the clock pulse signals $\phi_2$ are not applied to the counters 24 and 25 and the contents of the counters 24 and 25 are all retained at "1" state.

When the count in the counters 24 and 25 is lower than the allowable full count value, binary "0" are generated at the terminals B of the counters, inverted at the inverters 30 and 31 to binary "1"'s, and applied to the AND gates 28 and 29. As a result, gates 20 and 29 are enabled and the clock pulse signals $\phi_2$ are applied to the counters 24 and 25 which begin counting the same.

With the above-described operation of the individual elements of the embodiment of FIG. 4, the general operation of the second embodiment is as follows. The clock pulse signals $\phi_2$ are generated even when the keys are not operated. These pulses are counted by counters 24 and 25 until the count in the counters reaches the respective maximum value. As such, the contents of the counters 24 and 25 are all replete with binary "1"'s when the keys are not operated. In the following description, it is assumed that the period 2T (twice that of the carry signals CR) is longer than the one wave length of the decaying oscillating wave shown in FIG. 2A. The invention is not, however, so limited. The period 2T may also be shorted than one wave length of the decaying oscillating wave DW, if desired.

When a key is operated, the first carry signal CR is generated by the accumulator 5 and a binary "1" is generated by AND gate 22 causing counter 24 to reset to zero. As a result, a binary "0" appears at the output terminal B of counter 24 and the clock pulse signal $\phi_2$ is applied to terminal A of counter 24 via AND gate 28. Counter 24 begins counting the clock pulse signals $\phi_2$ sequentially and generates an output signal on lines 43 which is representative of the instantaneous count in the counter 24. This signal is applied as an address signal to the wave shape memory 26. The wave shape memory 26 sequentially outputs the decaying oscillating waves DW shown in FIG. 2A in response to this signal.

When the count in counter 24 reaches its maximum value, the wave shape memory 26 will have completed the output of the wave shape shown in FIG. 2A and the content of the counter 24 will be replete with "1" causing the terminal B of the counter 24 to generate a binary "1". This signal is inverted by inverter 30 thereby disabling AND gate 28 and preventing clock pulse signals $\phi_2$ from being applied to counter 24. The content of the counter 24 is accordingly retained at "1" state fully.

This condition is maintained until a logic value "1" is again applied to the reset terminal R of the counter 24 via AND gate 22. At this point, counter 24 is reset. As already described, the carry signals CR are sequentially outputted with the generation period T from the terminal C of the accumulator 5, outputted alternately from the AND gates 22 and 23 by the operation of the flip-flop 21, and inputted to the reset terminals R of the counters 24 and 25 alternately. Thus, the content of the counter 24 is fully retained at "1" state until the third carry signal CR is outputted from the terminal C of the accumulator 5 and again inputted to the reset terminal R of the counter 24 via the and gate 22.

Next, as the second carry signal CR is outputted from the accumulator 5 and the logical value "1" is outputted from the AND gate 22 as the reset signal, the counter 25 and the AND gate 29 carry out operations quite similar to the ones already explained with respect to counter 24 and the counter 25 initiates counting of the clock pulse signals $\phi_2$. The wave shape memory 27 receives the count value of the counter 25 as an address signal in order to output a decaying oscillating wave DW shown in FIG. 2A. Under the condition that the counter 25 has counted its allowable full count number and the wave shape memory 27 has completed output of the decaying oscillating wave DW shown in FIG. 2A so that the content of the counter 25 is replete with "1", a logic value "1" is outputted from the terminal B of the counter 25 and AND gate 29 is disabled. Accordingly, no clock pulse signals $\phi_2$ are applied to counter 25. Consequently, content of the counter 25 is fully retained at "1" state.

The condition is maintained until a logic value "1" is again applied to the reset terminal R of counter 25 via AND gate 23 and counter 25 is reset. As described already, the carry signals CR are sequentially generated with the generation period T from the terminal C of accumulator 5, outputted alternately from AND gates 22 and 23 by operation of flip-flop 21, and inputted to the reset terminals R of counters 24 and 26 alternately. Thus, the content of counter 24 is fully retained at "1" state until the fourth carry signal CR is again passed from the terminal C of the accumulator 5 to the reset terminal R of the counter 25 via the AND gate 23.

Figure 5:
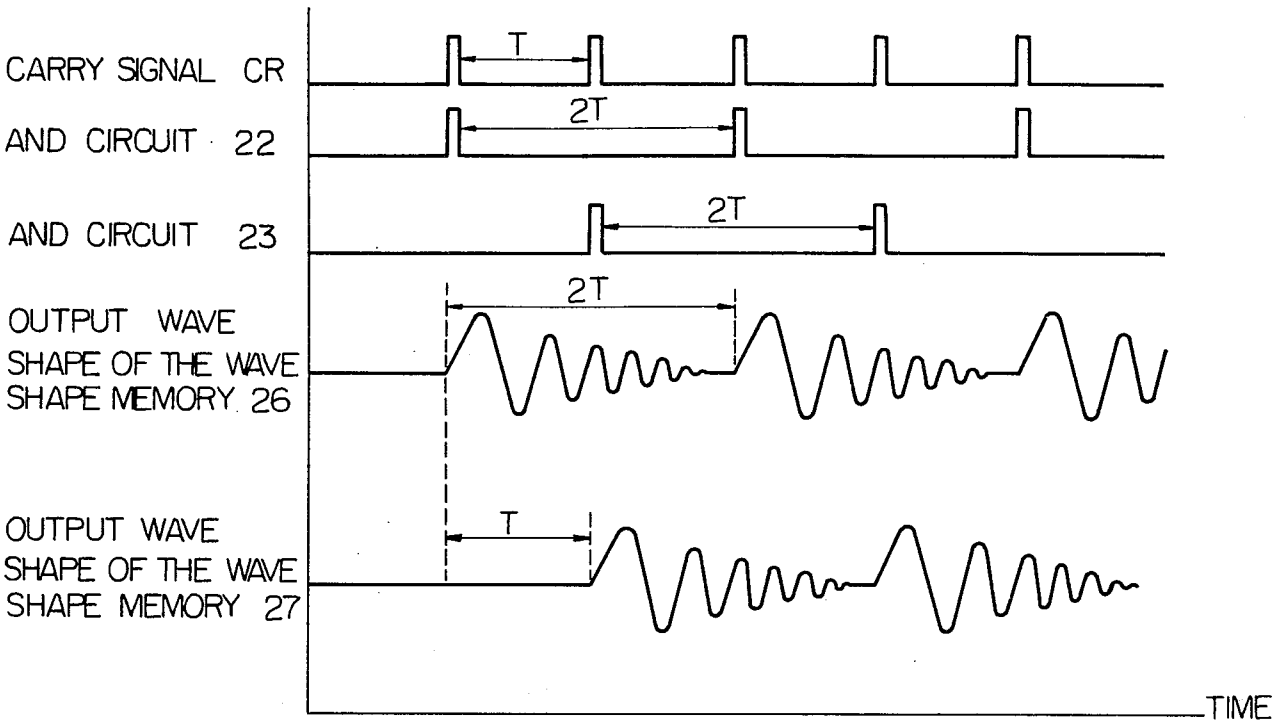
FIG. 5 is a timing chart for the operation of the embodiment of FIG. 4.

Therefore, at times shown in FIG. 5, the wave shape memories 26 and 27 generate wave shapes having a phase difference equal to the generation period T of the carry signals CR and the respective wave shapes are generated sequentially with generation periods 2T doubling that of the carry signals CR.

Figure 6A:
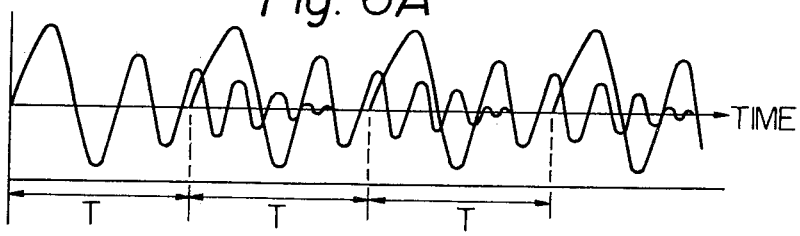
FIGS. 6A and 6B are graphs illustrating examples of the wave shape signals output from the wave shape memories used in the embodiment of in FIG. 4.
Figure 6B:
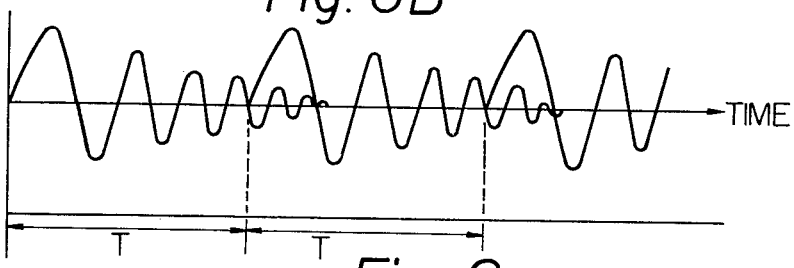

As previously described, the generation period T of the carry signals CR appearing at terminal C of accumulator 5 is inversely proportional to the pitch of the operated key. For example, the generation period T for a high note key is short accordingly, the wave shapes generated by the wave shape memories 26 and 27 respectively to overlap each other by a considerable amount as shown in FIG. 6A. In contrast, the generation period T for a low note key is long, thereby reducing the degree of overlap of the wave shapes generated by wave shape memories 26 and 27 respectively. See FIG. 6B.

In accordance with the second embodiment of the invention, first and second wave shapes are generated, each with a generation period 2T from the wave shape memories 26 and 27, respectively, in response to the carry signals CR generated with a generation period T corresponding to the operated key. The two wave shapes have a phase difference T and are added to each other at the adder 32 in order to generate a corresponding musical tone. As a result, musical tones of different wave shapes are generated by the operation of different keys.

The musical tonal wave shapes so obtained are applied to the multiplier 13 where they are multiplied by the envelope waves EV generated by the envelope wave generator 15 upon receipt of the key-on signals KON from the key-board circuit 1. In this manner, proper tone volume envelopes are given to the musical tonal wave shapes for generation of musical tones by the sound system 19.

It is further preferable to interpose a suitable delay element to the connection between the carry signal output terminal C of the accumulator 5 and the AND gates 22 and 23 at a point Z. Without such a delay element, one of the two signals input to the AND gates 22 and 23, i.e. the signal from the flip-flop 21, is applied to AND gates 22 and 23 with a time delay equal to the operation time of the flip-flop 21, from the generation of the carry signals CR. This time delay is caused by the fact that flip-flop 21 operates upon receipt of the carry signals. Such a time delay tends to cause undesirable malfunctions of AND gates 22 and 23, which may make it impossible to attain the above-described logic operation. Insertion of the above-described delay element assures adjustment in the input timing of the two signals to AND gates 22 and 23, thereby successfully avoiding possible malfunctions of the AND gates 22 and 23.

In the foregoing description, it has been assumed that the same decaying oscillating wave DW shown in FIG. 2A is stored in both wave shape memories 26 and 27. However, the present invention is not so limited and different wave shapes may be stored in each of the wave shape memories 26 and 27.

In the case of the above-described second embodiment of the invention, generation of the musical tones starts after the first carry signal CR is generated by accumulator 5 upon operation on a certain key. It is, however, possible to generate musical tones simultaneously with operation of the key. For this effect, a suitable Or gate may be inserted between the AND gate 23 and the counter 25, whereby the key-on signals KON from the keyboard circuit 1 are passed to the input side of the above-described Or gate via a suitable inverter. This variant may correspond to the combination of the inverter 17 and the OR gate 7 employed in the first embodiment shown in FIG. 1.

Figure 7:
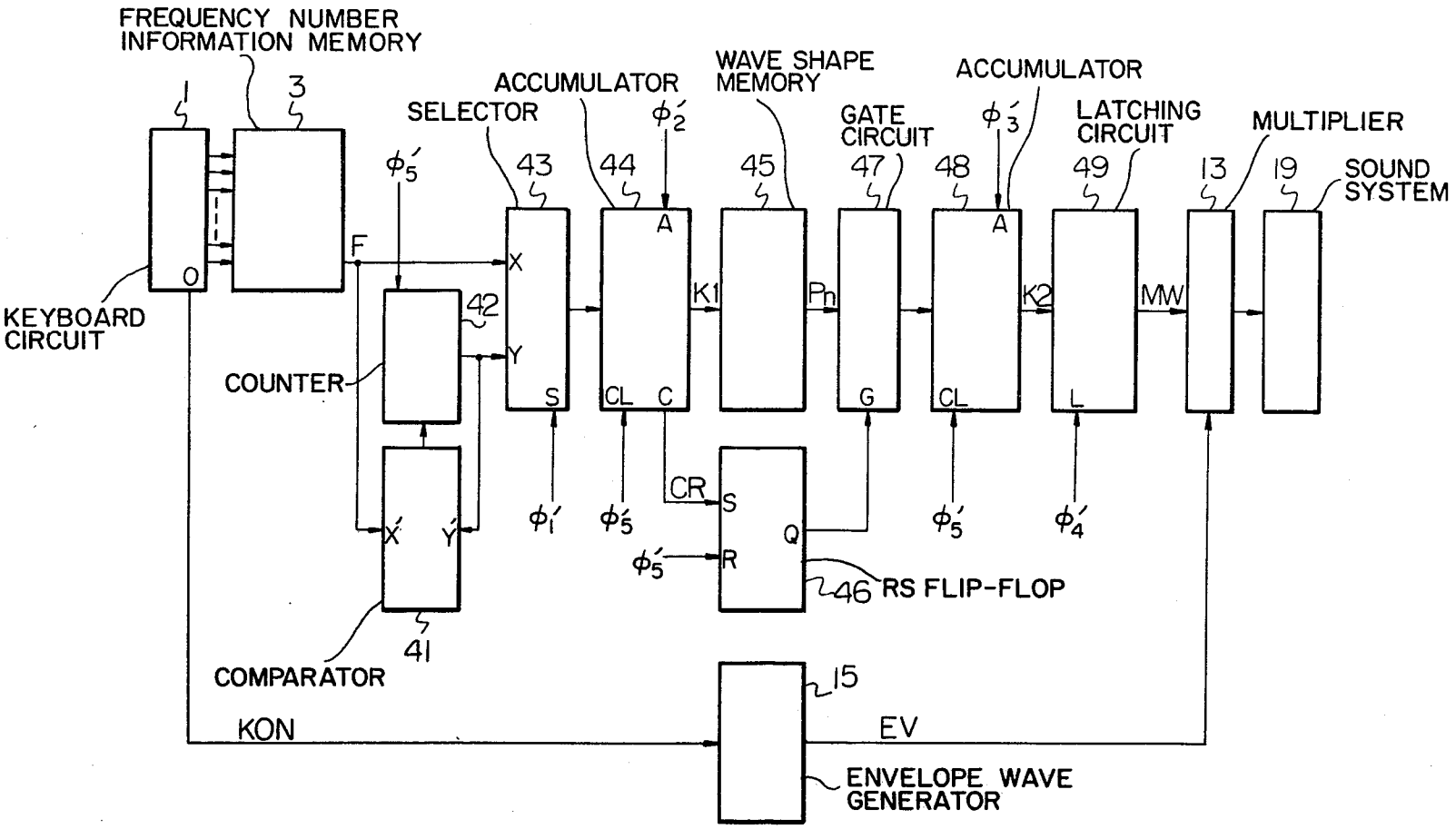
FIG. 7 is a block diagram illustrating the construction of a third embodiment of the present invention.

The third embodiment of the present invention is shown in FIG. 7 in which like elements as the ones used in the first and second embodiments are designated with like reference symbols. The use of two wave shape memories in the second embodiment requires enlargement in the entire construction of the instrument. In order to avoid this drawback, the third embodiment uses a single wave shape memory while utilizing a time division system for reading the same.

In the construction shown in FIG. 7, the output of frequency information memory 3 is coupled to both the first input terminal X or a selector 43 and to the first input terminal X of a comparator 41. The selection command terminal S of the selector 43 receives clock pulse signals $\phi_1'$ shown in FIG. 8 whereas the count input of a counter 42 receives clock pulse signals $\phi_5'$ also shown in FIG. 8. The output of counter 42 is coupled to both the second input terminal Y of selector 43 and to the second input Y of comparator 41.

Figure 8:
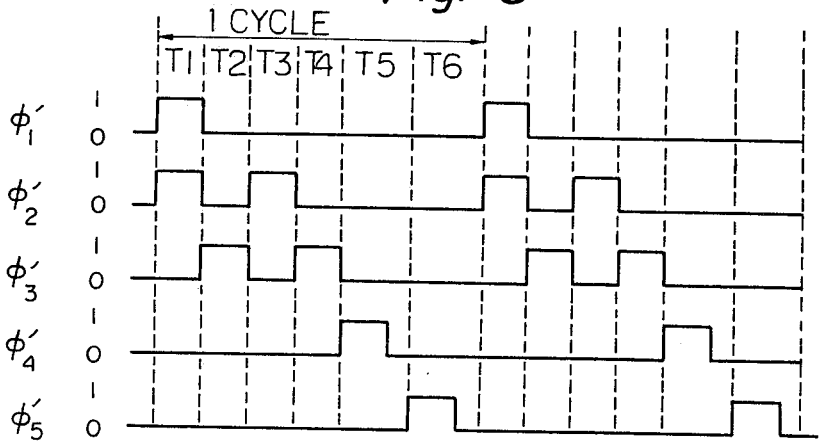
FIG. 8 is a timing chart illustrating various clock pulse signals used in the embodiment of FIG. 7.

The output of selector 43 is coupled to the input of an accumulator 44 whose accumulation command terminal A receives clock pulse signals $\phi_2'$ shown in FIG. 8. The clear terminal CL of accumulator 44 also receives clock pulse signals $\phi_5'$. The output of accumulator 44 is coupled to the input of wave shape memory 45 and the carry signal output terminal C of accumulator 44 is coupled to the set terminal S of an RS-type flip-flop 46.

Clock pulse signals $\phi_5'$ are applied to the reset terminal R of flip-flop 46 whose output terminal Q is coupled to the gating control terminal G of a gate circuit 47. The input of gate circuit 47 is coupled to the output of the wave shape memory 45. The output of gate circuit 47 is coupled to the input of accumulator 48 whose clear terminal CL receives clock pulse signals $\phi_5'$. The accumulator 48 is further provided with an accumulation command terminal A which receives clock pulse signals $\phi_3'$ shown in FIG. 8. The output of accumulator 48 is coupled to the input of a latching circuit 49 whose latch command terminal L receives clock pulse signals $\phi_4'$ shown in FIG. 8. The output of latching circuit 49 is coupled to the input of multiplier 13.

The comparator 41 compares frequency information signals F applied to its input terminal X' with the count number N of the counter 42 applied to its input terminal Y' and generates a binary "1" only when the frequency information signal F≦count number N. Hereinafter, this condition will be referred to as the "comparator condition".

The accumulator 44 accumulates input signals at times defined by the clock pulse signals $\phi_2'$ applied to its accumulation command terminal A. When the clock pulse signals $\phi_5'$ is applied to its clear terminal CL, the count in the accumulator 44 is cleared. When the accumulated value K1 reaches or exceeds the last address of the wave shape memory 45, a carry signal CR is generated at terminal C of accumulator 44. The accumulator 48 accumulates input signals at times defined by the clock pulse signals $\phi_3'$ applied to its accumulation command terminal A. When the clock pulse signals $\phi_5'$ are applied to its clear terminal CL, the count in the accumulator 48 is cleared. The selector 43 permits passage of the signals already applied to its input terminal Y and cuts off the signal already applied to its input terminal X when a binary "1" is applied to its selection command terminal S. On the other hand, selector 43 permits passage of the signal already applied to its input terminal X and cuts off the signal already inputted to the terminal Y.

The gating circuit 47 closes when a binary "1" is applied to the gating control terminal G thereof. The decaying oscillating wave DW shown in FIG. 2A is stored in the wave shape memory 45.

With the above-described construction, the third embodiment of the present invention operates sequentially as follows, reference being made to the clock pulse signals $\phi_1'$ through $\phi_5'$ shown in FIG. 8.

When a key of the keyboard is operated, a binary "1" appears on that output line of the keyboard circuit 1 which corresponds to the operated key as in the second embodiment. Upon receipt of this binary "1", the frequency information memory 3 reads out the frequency information signal F corresponding to the tone frequency of the operated key. Simultaneously, a clock pulse signal generator (not shown) starts to generate the clock pulse signals $\phi_1'$ through $\phi_5'$ shown in FIG. 8.

During time interval T1, the frequency information signal F is, on one hand, applied to the input terminal X of the selector 43 and, on the other hand, to the input terminal X' of the comparator 41. At this stage of the process, the clock pulse signal $\phi_5'$ is at the logic "0" value, counting operation by the counter 42 is not yet initiated and the count value N thereof remains zero. As a result, the count value N=0 is applied to the input terminals Y and Y' of selector 43 and the comparator 41, respectively. The terminal X' of comparator 41 receives the frequency information signal F and the terminal Y' thereof receives the count value N (=0). Since the frequency information signal F is larger than the count value N, the comparator condition is not satisfied and comparator 41 outputs a binary "0". This has no influence upon the counting operation by the counter 42.

The frequency information signal F and the count value N (=0) are applied to the X and Y input terminals, respectively, of the selector 43. However, since the clock pulse signal $\phi_1'$ applied to the selection command terminals S of the selector 43 is at a binary "1" value during the time interval T1, the signal applied to input terminal Y is permitted to pass. That is, the count value N=0 is applied to accumulator 44 through the selector 43. Since the clock pulse signal $\phi_2'$ at the accumulation command terminal A of accumulator 44 assumes the logic value "1" at this time, the input count value N=0 is accumulated therein. Thus the accumulated value K1 appearing at the output of accumulator 44 is equal to the count value N=0. Since the accumulated value K1=0 is applied to the address input of wave shape memory 45, a wave sample value $P_0$ stored at the address O of the memory 45 is read out. This wave sample value corresponds to the point $P_0$ in FIG. 9 and is passed to the accumulator 48 via the gate circuit 47. Operation of the gate circuit 47 and flip-flop 46 will be described in more detail below.

During time interval T2, the clock pulse signal $\phi_3'$ assumes the logic "1" value and accumulator 48 accumulates the wave sample value $P_0$. Simultaneously, the clock pulse signal at the selection command terminal S of selector 43 assumes the logic "0" value and, only the signal at the terminal X is allowed to pass. Thus, the frequency information signal F at the terminal X is applied to accumulator 44 through the selector 43.

During time interval T3, the clock pulse signal $\phi_2'$ assumes the logic value "1", causing accumulator 44 to begin accumulating the frequency information signal F. In this condition, the accumulated value K1 appearing at the output of accumulator 44 is generally given in the form of (F+N). However, since the count value accumulated in the accumulator 44 during the time interval T1 is zero, the value K1 accumulated during the time. T3 is equal to the frequency information signal F. This accumulated value K1(=F) is applied to the address input of wave shape memory 45 as an address signal and a wave sample value $P_0'$ stored at the address K1(=F) of wave shape memory 45 is read out. In this case, the wave sample value to be read out corresponds to the point $P_0'$ in FIG. 9. This wave sample value $P_0'$ is applied to accumulator 48 via the gate circuit 47.

During time interval T4, the clock pulse signal $\phi_3'$ assumes the logic "1" value and the wave sample value $P_0'$ is accumulated in accumulator 48. Thus, the accumulated value K2 of the accumulator 48 the time interval T4 is given in the form $(P_0+P_0')$, i.e. a sum of the wave sample values at the points $P_0$ and $P_0'$ in FIG. 9. The accumulated value $K2=P_0+P_0'$ is then applied to the latching circuit 49.

During time interval T5, the clock pulse signal $\phi_4$ at the latch command terminal L of latching circuit 49 assumes the logic "1" value circuit 49 latches the accumulated value $K2(=P_0+P_0')$ appearing at the output of accumulator 48 and applies this value to multiplier 13.

During time interval T6, the clock pulse signal $\phi_5'$ assumes the logic "1" value and the counter 42 increases its stored count from 0 to 1. Further, the clock pulse signal $\phi_5'$ is applied to the reset terminals R of the accumulators 44 and 48 in order to reset the same.

Figure 9:
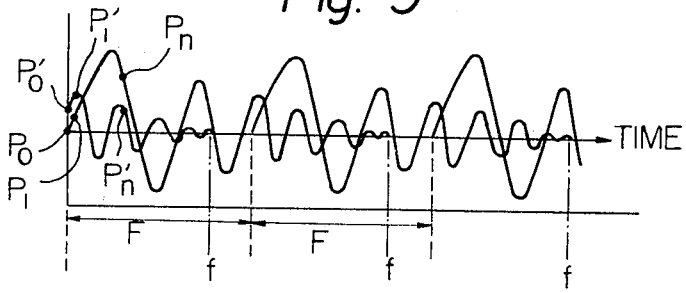
FIG. 9 is a graph illustrating an example of the musical tonal wave shape generated by the embodiment of in FIG. 7.

As is clear from the foregoing, generation of the clock pulse signals $\phi_1'$ through $\phi_5'$ concurrently with the key operation in the first cycle, the wave sample values $P_0$ and $P_0'$ stored at addresses O and F, respectively, of wave shape memory 45 are read out in a multiplexed manner, the wave sample values $P_0$ and $P_0'$ are accumulated at the accumulator 48 and latched in the latching circuit 49, thereby fixing the first sampling point $(P_0+P_0')$ of the wave shape signal MW shown in FIG. 9. Concurrently, counter 42 counts the clock pulse signal $\phi_5'$ in order to convert the count value N from 0 to 1.

Generation of the clock pulse signals $\phi_1'$ through $\phi_5'$ in the second cycle causes corresponding operation quite similar to that caused by the generation in the first cycle. However, in this cycle, the count value N of the counter 42 is equal to 1 and, therefore, a wave sample value $P_1$ stored at the address 1 of the wave shape memory 45 is read out during time interval T1. Similarly, a wave sample value $P_1'$ stored at the address (F+1) of the memory 45 is read out during time interval T2 and accumulation is carried out at the accumulator 48 during time interval T4. Thus, generation of the clock pulse signals $\phi_1'$ through $\phi_5'$ in the second cycle causes a wave sample value $(P_1+P_1')$ to be inputted to the latching circuit 49 as the accumulated value K2 of the accumulator 48, thereby fixing the second sampling point $(P_1+P_1')$ of the wave shape signal MW as shown in FIG. 9. Concurrently, counter 42 counts the clock pulse signal $\phi_5'$ so that the count value N thereof changes from 1 to 2.

The above-described operation is repeated and summerized in the following Table wherein the count value N of the counter 42 is equal to n (where n 0, 1, 2, . . . , F).

TABLE

| Time | T1 | T2 | T3 | T4 | T5 | T6 |
|---|---|---|---|---|---|---|
| Signal passable terminal of selector 43 | Y | | | X | | |
| Count value N of counter 42 | | | n | | | n + 1 |

TABLE-continued

| | | | | |
|---|---|---|---|---|
| Accumulated value K1 of accumulator 44 | n | | n + F | 0 |
| Output value of wave shape memory 45 | Pn | | Pn' | 0 |
| Accumulated value K2 of accumulator 48 | 0 | Pn | Pn + Pn' | 0 |
| Output value of latching circuit 49 | | 0 | | Pn + Pn' |

As is clear from the foregoing, repeated generations of clock pulse signals $\phi_1'$ through $\phi_5'$ makes latching circuit 49 sequentially output the sampling points (Pn+Pn'), n being 0, 1, 2, . . . F, of the wave shape signal MW shown in FIG. 9 in order to form a wave shape signal MW. Further, counter 42 is reset upon receipt of the logic value "1" from comparator 41. This logic value is generated when the count value N of the counter 42 becomes equal to or exceeds the frequency information F from the frequency information signal memory 3 and the above-described comparator condition is satisfied at the comparator 41. After it is reset, counter 42 begins a new counting operation from the count value N equal to zero for formation of the wave shape signal MW in the next cycle. Thus, the one cycle period of the wave shape signal MW is equal to the frequency information signal F to be generated corresponding to the operated key as shown in FIG. 9.

Referring again to FIG. 7, the combination of flip-flop 46 with gate circuit 47 functions to prevent the value read out of wave shape memory 45 from being applied to accumulator 48 when the accumulated value K1 of accumulator 44 exceeds the last address in memory 45. That is, as the accumulated value K1 of accumulator 44 exceeds the last address in wave shape memory 45, a carry signal CR is generated at from the terminal C of accumulator 44 and applied to the set terminal S of the flip-flop 46. The terminal $\overline{Q}$ of the flip-flop 46 is inverted from the logic value "0" to "1", whereby a logic value "1" is applied to gating control terminal G of gate circuit 47. This disables gate circuit 47 and the output of wave shape memory 45 cannot be applied to accumulator 48. As a result, of the wave shape of the advanced phase, i.e. the wave shape on which the points Pn' are marked, disappears completely at a point f. There is no influence upon formation of the wave shape of the delayed phase, i.e. the wave shape on which the points Pn are marked, since the accumulated valve K1 of the accumulator 44 in this condition does not yet exceed the last address of the wave shape memory 45.

The wave shape signals MW so generated are multiplied by the corresponding envelope waves EV from the generator 15 at the multiplier 13 and applied to the sound system 19 for generation of musical tones.

In accordance with the third embodiment of the present invention, application of the time division multiplexing system to operation of a single wave shape memory 45 assures a remarkably compact construction of the instrument while retaining the excellent function possessed by the second embodiment. This greatly enables lowering in the manufacturing cost without degrading any acoustic effect.

It will be well understood from the foregoing description that employment of the present invention assures generation of musical tones of different tone colors for different operated keys as is the case in acoustic keyboard musical instruments. It is also possible to carry out simulation of musical tones such as the one generated by applying a drive pulse, e.g. lip vibration of the player, corresponding to the frequency of the musical tone to a fixed filter, e.g. a trumpet. Thus, the present invention assures ideal improvement in the function of electronic keyboard musical instruments.

We claim:

1. An electronic keyboard instrument, comprising:

a keyboard having a plurality of keys;

a keyboard circuit connected to said keyboard and generating a key identity output signal indicating which of said keys is being operated each time at least one of said keys is operated;

a waveshape memory storing a desired waveshape in the form of a plurality of sample values, each of said sample values being stored in a respective address location of said memory, said waveshape memory generating that sample value stored in the address location addressed by an address signal applied thereto;

a read-out circuit coupled to said waveshape memory and applying a set sequence of address signals to said memory at a constant frequency, said read-out circuit reinitiating the application of said set sequence of address signals to said waveshape memory each time a reset signal is applied thereto;

a reset signal generator circuit receiving said key identity output signals and applying reset signals to said read-out circuit with a period which varies as a function of the tone pitch associated with the key being operated;

a sound system for generating acoustic tones which vary as a function of said sample values generated by said waveshape memory.

2. An electronic keyboard instrument, comprising:

a keyboard having a plurality of keys;

a keyboard circuit connected to said keyboard and generating a key identity output signal indicating which of said keys is being operated and a key on output signal indicating that at least one of said keys is being operated, each time at least one of said keys is operated;

a waveshape memory storing a desired waveshape in the form of a plurality of sample values, each of said sample values being stored in a respective address location of said memory, said waveshape memory generating that sample value stored in the address location addressed by an address signal applied thereto;

a read-out circuit coupled to said waveshape memory and applying a set sequence of address signals to said memory at a constant frequency, said read-out circuit reinitiating the application of said set sequence of address signals to said waveshape memory each time a reset signal is applied thereto;

a reset signal generator circuit receiving said key identity output signals and applying reset signals to said read-out circuit with a period which varies as a function of the tone pitch associated with the key being operated;

an envelope wave generator circuit coupled to said keyboard circuit and generating an envelope wave responsive to the generation of said key on output signal;

a multiplier for multiplying the output of said waveshape memory by said envelope wave; and a sound system coupled to said multiplier for generating acoustic tones which vary as a function of the product of said multiplier.

3. An electronic musical instrument as claimed in claims 2 or 1, wherein said reset signal generator circuit includes a frequency information memory coupled to said keyboard circuit and storing a plurality of frequency information signals, each of said frequency information signals being proportional to the tone pitch of an associated one of said keys, said frequency information memory outputting that frequency information signal which is proportional to the tone pitch of said key identified by said key identity output signal generated by said keyboard circuit.

4. An electronic musical instrument as claimed in claim 3, wherein said read-out circuit includes:

a counter coupled to said waveshape memory and generating said address signals at a frequency determined by a series of first clock pulse signals; and means for generating said first clock pulse signals at constant intervals.

5. An electronic musical instrument as claimed in claim 4, in which said reset signal generator further includes:

an accumulator accumulating said frequency information signal outputted by said frequency information memory responsive to the generation of a series of second clock pulse signals, and generating one said reset signal each time the accumulated value of said accumulator becomes equal to the allowable full count number of said accumulator; and means for generating said second clock pulse signals at constant intervals.

6. An electronic musical instrument as claimed in claim 5, wherein said reset signal generator further includes an OR gate having first and second inputs, said first input receiving said reset signal generated by said accumulator; said second input receiving the output of an inverter which receives said key on output signals, said OR gate having an output coupled to a reset input of said counter.

7. An electronic keyboard instrument, comprising:

(A) a keyboard having a plurality of keys;

(B) a keyboard circuit connected to said keyboard and generating a key identity output signal indicating which of said keys is being operated and a key on signal indicating that at least one of said keys is being operated, each time at least one of said keys is operated;

(C) a first waveshape memory storing a first desired waveshape in the form of a first plurality of sample values, each of said first plurality of sample values being stored in a respective address location of said first waveshape memory, said first waveshape memory generating that sample value stored in its address location addressed by a first address signal applied thereto;

(D) a second waveshape memory storing a second desired waveshape in the form of a second plurality of sample values, each of said sample values of said second set of sample values being stored in a respective address location of said second memory, said second waveshape memory generating that sample value stored in its address location addressed by a second address signal applied thereto;

(E) read-out circuit means coupled to said first and second waveshape memories and applying:

(1) a set sequence of first address signals to said first waveshape memory at a constant frequency, said read-out circuit reinitiating the application of said set sequence of first address signals to said first waveshape memory each time a first reset signal is applied thereto;

(2) a set sequence of second address signals to said second memory at a constant frequency, said read-out circuit reinitiating the application of said set sequence of second address signals to said second memory each time a second reset signal is applied thereto;

(F) a reset signal generator circuit receiving said key identity output signals and alternately applying said first and second reset signals to said read-out circuit at a frequency which varies as a function of the tone pitch associated with the key being operated;

(G) means for adding the sample values generated by said first and second memories so as to generate a third sequence of sample values;

(H) an envelope wave generator circuit coupled to said keyboard circuit and generating an envelope wave responsive to the generation of said key on signal;

(I) a multiplier for multiplying the output of said waveshape memory by said envelope wave; and (J) a sound system coupled to said multiplier for generating acoustic tones which vary as a function of the product of said multiplier.

8. An electronic musical instrument as claimed in claim 7, wherein said reset signal generator circuit includes a frequency information memory coupled to said keyboard circuit and storing a plurality of frequency information signals, each of said frequency information signals being proportional to the tone pitch of an associated one of said keys, said frequency information memory outputting that frequency information signal which is proportional to the tone pitch of said key identified by said key identity output signals generated by said keyboard circuit.

9. An electronic musical instrument as claimed in claim 8, wherein said read-out circuit includes:

a first counter coupled to said first waveshape memory and generating said set sequence of first address signals at a frequency determined by a series of first clock pulse signals;

a second counter coupled to said second waveshape memory and generating said set sequence of second address signals at a frequency determined by said first series of clock pulse signals; and means for generating said first clock pulse signals at constant intervals.

10. An electronic instrument as claimed in claim 9, wherein said reset signal generator circuit further includes an accumulator which accumulates said frequency information signals generated by said frequency information memory and generates a carry signal, which carry signal determines the frequency of said first and second reset signals, each time the accumulated value in said accumulator becomes equal to an allowable full count number of said accumulator.

11. An electronic instrument as claimed in claim 10, wherein said reset signal generator further includes:

a flip-flop having first and second complementary outputs, the state of said flip-flop outputs being toggled each time said accumulator generates one of said carry signals;

a first AND gate having first and second inputs and an output, said first AND gate output being coupled to a reset input of said first counter, said first AND gate first input being coupled to one output of said flip-flop, said first AND gate second input receiving said carry signals; and a second AND gate having first and second inputs and an output, said second AND gate output being coupled to a reset input of said second counter, said second AND gate first input being coupled to the other output of said flip-flop, said second AND gate second input receiving said carry signals.

12. An electronic instrument as claimed in claim 11, wherein said carry signals are applied to said second input of said first and second AND gates via a delay element.

13. An electronic instrument as claimed in claim 11, wherein an OR gate is interposed between said second AND gate and said second counter, and wherein said OR gate has first and second inputs, said OR gate first input receiving said key on signals via an inverter, said OR gate second input receiving said carry signals.

14. An electronic instrument as claimed in claim 7, wherein similar waveshapes are stored in both said first and second waveshape memories.

15. An electronic instrument as claimed in claim 7, wherein different waveshapes are stored in said first and second waveshape memories.

16. An electronic musical instrument, comprising;

a keyboard having a plurality of keys;

a keyboard circuit connected to said keyboard and generating a key identity output signal indicating which of said keys is being operated and a key on output signal indicating that at least one of said keys is being operated, each time at least one of said keys is operated;

a waveshape memory storing a desired waveshape in the form of a plurality of sample values, each of said sample values being stored in a respective address location of said memory, said waveshape memory generating that sample value stored in the address location addressed by an address signal applied thereto;

a frequency information memory coupled to said keyboard circuit and storing a plurality of frequency information signals, each of said frequency information signals being proportional to the tone pitch of an associated one of said keys, said frequency information memory outputting that frequency information signal which is proportional to the tone pitch of said key identified by said key identity output signal generated by said keyboard circuit;

a counter for counting a series of first clock pulse signals;

a comparator for comparing the value of said frequency information signal generated by said frequency information memory to the stored count in said counter, said comparator generating an output signal when the stored count in said counter exceeds the value of said frequency information signal generated by said frequency information memory, said output signal generated by said comparator clearing the stored count in said counter;

a selector having first and second input terminals and an output terminal, said first input terminal receiving said frequency information signals, said second input terminal receiving a signal indicative of the stored count in said counter, said selector also having a selection command terminal which receives a series of second clock pulse signals, the presence or absence of which determines which of said first and second input terminals of said selector is coupled to said output terminal of said selector;

a first accumulator accumulating signals appearing at said output terminal of said selector responsive to the generation of a third series of clock pulse signals, the accumulated value in said first accumulator being cleared each time one of said first clock pulse signals is generated, said first accumulator generating:

(a) accumulated value signals indicating the accumulated value in said first accumulator, said accumulated value signals defining said address signals; and (b) a carry signal whenever the accumulated value in said accumulator exceeds the number of the last address location in said waveshape memory;

a flip-flop having a set terminal receiving said carry signals generated by said first accumulator and a reset terminal receiving said first clock pulse signals;

a gate circuit having an input and an output, said gate circuit input receiving said sample values generated by said waveshape memory, said gate circuit applying the sample value appearing at its input to its output whenever said flip-flop is set;

a second accumulator accumulating said sample values appearing at the output of said gate circuit responsive to the generation of each one of a series of fourth clock pulse signals, the accumulated value in said second accumulator being cleared each time one of said first clock pulse signals is generated;

a latching circuit for latching the accumulated count in said second accumulator responsive to the generation of each of a series of fifth clock pulse signals;

means for generating said first, second, third, fourth and fifth clock pulse signals;

an envelope wave generator circuit coupled to said keyboard circuit and generating an envelope wave responsive to the generation of each said key on output signal;

a multiplier for multiplying the output of said latching circuit by said envelope wave; and a sound system coupled to said multiplier for generating acoustic tones which vary as a function of the product of said multiplier.

* * * * *